US009108815B2

(12) United States Patent
Hatakeyama

(10) Patent No.: US 9,108,815 B2
(45) Date of Patent: Aug. 18, 2015

(54) SHEET TRANSPORT APPARATUS AND IMAGE FORMING SYSTEM

(71) Applicant: BROTHER KOGYO KABUSHIKI KAISHA, Nagoya-shi, Aichi-ken (JP)

(72) Inventor: Yuichi Hatakeyama, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/294,670

(22) Filed: Jun. 3, 2014

(65) Prior Publication Data

US 2015/0091238 A1 Apr. 2, 2015

(30) Foreign Application Priority Data

Sep. 30, 2013 (JP) ..... 2013-204487

(51) Int. Cl.

| | |
|---|---|
| ***B65H 5/34*** | (2006.01) |
| ***B65H 7/20*** | (2006.01) |
| ***B65H 7/06*** | (2006.01) |
| ***B65H 5/00*** | (2006.01) |
| ***B65H 5/06*** | (2006.01) |

(52) U.S. Cl.

CPC .. *B65H 7/20* (2013.01); *B65H 5/00* (2013.01); *B65H 5/068* (2013.01); *B65H 5/34* (2013.01); *B65H 7/06* (2013.01); *B65H 2407/30* (2013.01); *B65H 2515/32* (2013.01); *B65H 2601/12* (2013.01)

(58) Field of Classification Search

CPC ..... B65H 7/00; B65H 7/02; B65H 7/20; B65H 5/00; B65H 2601/12; B65H 2515/32; B65H 2407/30; B65H 5/068; B65H 5/34

USPC ..... 271/4.02

See application file for complete search history.

(56) References Cited

U.S. PATENT DOCUMENTS

| | | | | |
|---|---|---|---|---|
| 9,002,256 | B2 * | 4/2015 | Tooker et al. | 399/394 |
| 2006/0074615 | A1 * | 4/2006 | Sugiyama | 703/6 |
| 2007/0052155 | A1 * | 3/2007 | Cook et al. | 271/152 |
| 2008/0079215 | A1 * | 4/2008 | Ouchi | 271/81 |
| 2009/0212491 | A1 * | 8/2009 | Noguchi et al. | 271/265.04 |
| 2010/0096799 | A1 * | 4/2010 | Shiraiwa et al. | 271/111 |
| 2014/0168308 | A1 * | 6/2014 | Samoto et al. | 347/16 |

(Continued)

FOREIGN PATENT DOCUMENTS

| | | | |
|---|---|---|---|
| JP | 2005-289531 | A | 10/2005 |
| JP | 2005-335302 | A | 12/2005 |

(Continued)

*Primary Examiner* — Patrick Cicchino

(74) *Attorney, Agent, or Firm* — Merchant & Gould PC

(57) ABSTRACT

A sheet transport apparatus includes: a first motor and a second motor; a first roller configured to: rotate upon receiving motive power from the first motor; and transport a sheet in a predetermined transport direction; a second roller which is provided on a downstream side of the first roller in the transport direction and which is configured to: rotate upon receiving motive power from the second motor while nipping the sheet transported by the first roller at a nip position; and transport the sheet further downstream in the transport direction; and a controller. The controller includes a motor control unit configured to perform a first process for rotating the first roller and a second process for rotating the second roller; and a first reaction-force estimating observer configured to calculate a first estimated value which is an estimated value of a reaction force acting on the first motor.

8 Claims, 10 Drawing Sheets

(56) References Cited

U.S. PATENT DOCUMENTS

| | | | | |
|---|---|---|---|---|
| 2014/0265111 | A1* | 9/2014 | Ishizuka et al. | 271/265.01 |
| 2014/0291926 | A1* | 10/2014 | Iesaki | 271/265.02 |
| 2014/0292874 | A1* | 10/2014 | Iesaki | 347/16 |
| 2015/0061207 | A1* | 3/2015 | Iesaki | 271/3.2 |
| 2015/0091238 | A1* | 4/2015 | Hatakeyama | 271/3.16 |

FOREIGN PATENT DOCUMENTS

| | | | |
|---|---|---|---|
| JP | 2009-177380 | A | 8/2009 |
| JP | 2012-046329 | A | 3/2012 |

* cited by examiner

SHEET TRANSPORT APPARATUS AND IMAGE FORMING SYSTEM

CROSS REFERENCE TO RELATED APPLICATION

The present application claims priority from Japanese Patent Application No. 2013-204487, filed on Sep. 30, 2013, the disclosure of which is incorporated herein by reference in its entirety.

BACKGROUND OF THE INVENTION

1. Field of the Invention

The present invention relates to a sheet transport apparatus which is configured to transport a sheet with rotation of a roller and an image forming system.

2. Description of the Related Art

There is conventionally known an image forming system which transports a sheet of paper placed on a tray along a transport path in a predetermined transport direction with rotation of a paper feed roller. In the image forming system, the paper transported with the rotation of the paper feed roller is supplied to a nip position at which the paper is nipped by a transport roller. The transport roller is positioned downstream of the paper feed roller in the transport direction. The paper supplied to the nip position of the transport roller is transported to an image-formation point positioned downstream of the transport roller with rotation of the transport roller.

In this type of image forming system, for example, the front end of the paper is positioned at the nip position by rotating the paper feed roller in a state that the transport roller is stopped or reversely rotated and thereby causing the paper to abut against the nip position of the transport roller. Thereafter, cueing of the paper to a target position positioned downstream of the nip position is performed by rotating the transport roller in a forward direction to transport the paper downstream in the transport direction. The "forward" direction referred herein is a rotation direction of the roller for transporting the paper downstream in the transport direction along the transport path. In the following description, the rotation direction of the roller in such a simple expression that the roller "rotates (is rotated)" means the "forward" direction.

Further, as a conventional system, there is known a system in which the paper is supplied to the nip position of the transport roller in a state that the transport roller is rotated in the forward direction (see Japanese Patent Application Laid-open No. 2005-335302). In this type of system, for example, in a case that image formation is performed continuously for a plurality of sheets of paper, the discharge of a preceding sheet of paper for which the image formation has been performed is performed concurrently with the cueing of a subsequent sheet of paper by rotating the transport roller in the forward direction.

In the system described in the above literature, a sensor which detects the front end of the paper is provided in the transport path between the paper feed roller and the transport roller. When the front end of the paper has been detected by the sensor in this system, a position count operation for the paper feed roller is started. In a case that a position count value for the paper feed roller has arrived at a predetermined value, a position count operation for the transport roller is started. Based on the position count value of the transport roller, the cueing of the paper to a target position is performed. The predetermined value corresponds to a rotation amount of the paper feed roller which is required to move the front end of the paper from a position at which the front end of the paper has been detected by the sensor to the nip position of the transport roller.

In this technique, however, it is more likely to cause an error between the count value and the actual paper transport amount, because the paper transport amount until the paper arrives at the nip position is indirectly measured by the position count operation of the paper feed roller. Therefore, it is easily to cause such a phenomenon that the paper does not reach the nip position when the position count value has arrived at the predetermined value. In this case, it is difficult to arrange the paper at the target position accurately.

SUMMARY OF THE INVENTION

The present invention has been made taking the foregoing problem into consideration, an object of which is to provide, in a system in which a sheet is supplied to a second roller positioned downstream in a transport direction with rotation of a first roller and the sheet is transported further downstream in the transport direction with rotation of the second roller, a technique capable of accurately arranging the sheet at a target position positioned downstream of a nip position of the second roller.

An image forming system of the present teaching includes a first motor, a second motor, a first roller, a second roller, and a controller. The first roller transports a sheet in a predetermined transport direction by rotating upon receiving motive power from the first motor. The second roller is provided on a downstream side of the first roller in the transport direction. The second roller transports the sheet further downstream in the transport direction by rotating upon receiving motive power from the second motor while nipping the sheet transported by the first roller at a nip position.

The controller includes a motor control unit and a first reaction-force estimating observer. The first reaction-force estimating observer calculates a first estimated value which is an estimated value of a reaction force acting on the first motor based on control input for the first motor and control output corresponding to the control input.

The motor control unit performs a first process in which the first motor is controlled to rotate the first roller and a second process in which the second motor is controlled to rotate the second roller. An operation for supplying the sheet to the second roller with the rotation of the first roller is controlled by the first process. An operation for transporting the sheet with the rotation of the second roller is controlled by the second process.

The motor control unit starts the second process before the sheet transported by the first process arrives at the nip position. Then, the motor control unit determines, on condition that a predetermined change indicating that the sheet has been started to be transported upon receiving action of force from the second roller has occurred in the first estimated value, a rotation amount of the second roller during a period from a reaction-force change point at which the predetermined change has occurred in the first estimated value until the second roller stops.

That is, the motor control unit controls the second motor in the second process so that the rotation amount of the second roller during the period from the reaction-force change point until the second roller stops corresponds to the rotation amount determined by the motor control unit. Accordingly, the sheet is arranged at the target position positioned on the downstream side of the nip position in the transport direction.

In a case that the sheet has been started to be transported with the rotation of the second roller upon arrival of the sheet at the nip position, the reaction force acting on the first roller changes owing to the transmission of force via the sheet. The image forming system of the present teaching observes the change in the reaction force and determines the rotation amount of the second roller from the reaction-force change point. Accordingly, the sheet is arranged at the target position positioned on the downstream side of the nip position of the second roller with high accuracy.

In the approach, such as the above conventional technique, in which the arrival of the front end of the sheet at the nip position is estimated based on the position count value after detection of the front end of the sheet with the sensor, the sheet may not be arranged at the target position with high accuracy owing to the influence of a slip of the paper and the like. That is, an error between a rotation amount of the first roller and an amount of displacement of the sheet may arise during a period from the sheet has been detected by the sensor until the sheet arrives at the nip position, which makes it difficult or impossible to arrange the sheet at the target position with high accuracy.

In contrast, according to the present teaching, since the estimated value of the reaction force is used as a parameter indicating a transport state of the sheet, the sheet can be arranged at the target position with high accuracy even under such an environment that the error occurs between the rotation amount of the roller and the amount of displacement of the sheet. Therefore, according to the present teaching, it is possible to produce a sheet transport apparatus with high performance.

DESCRIPTION OF THE EMBODIMENTS

Figure 1:
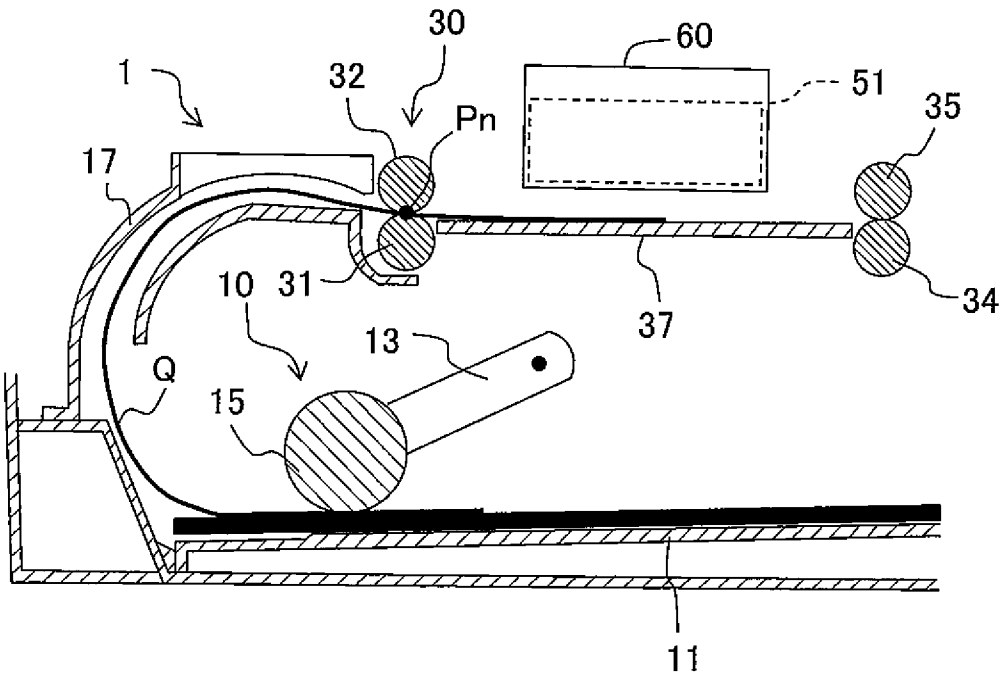
FIG. 1 schematically shows a cross-sectional structure of the periphery of a paper transport path in an image forming system.

Hereinbelow, embodiment(s) of the present teaching will be described while referring to the accompanying drawings. An image forming system 1 of this embodiment shown in FIG. 1 is configured as an ink jet printer. The image forming system 1 picks up one paper Q from among a plurality of sheets of paper Q supported by a paper feeding tray 11 and transports the one paper Q along a paper transport path in a predetermined transport direction, and cueing of the one paper Q to a lower area of an ink jet head 51 is performed. Then, ink droplets are discharged or jetted by the ink-jet head 51 to form an image in an area of the paper Q positioned on the lower side of the ink jet head 51. Thereafter, by repeatedly performing an operation for transporting the paper Q downstream in the transport direction by a predetermined amount (the transport of the paper Q to the downstream side in the transport direction by the predetermined amount is also referred to as "advancing or sending" hereinbelow) and an operation for discharging the ink droplets by the ink-jet head 51 (the discharge of the ink droplets is also referred to as "printing" hereinbelow), the image is formed in the paper Q. In the following description, the "downstream" means the downstream side in the transport direction of the paper Q.

A paper feed mechanism 10 provided for the image forming system 1 includes the paper feeding tray 11, an arm 13, and a paper feed roller 15. The paper feed mechanism 10 picks up one paper Q from among the plurality of sheets of paper Q supported by the paper feeding tray 11 and transports the paper Q downstream with rotation of the paper feed roller 15. The arm 13 rotatably supports the paper feed roller 15 and allows the paper feed roller 15 to abut against the paper Q disposed on the uppermost side in the paper feeding tray 11 by utilizing the urging or basing force of a spring or self-weight.

Figure 2:
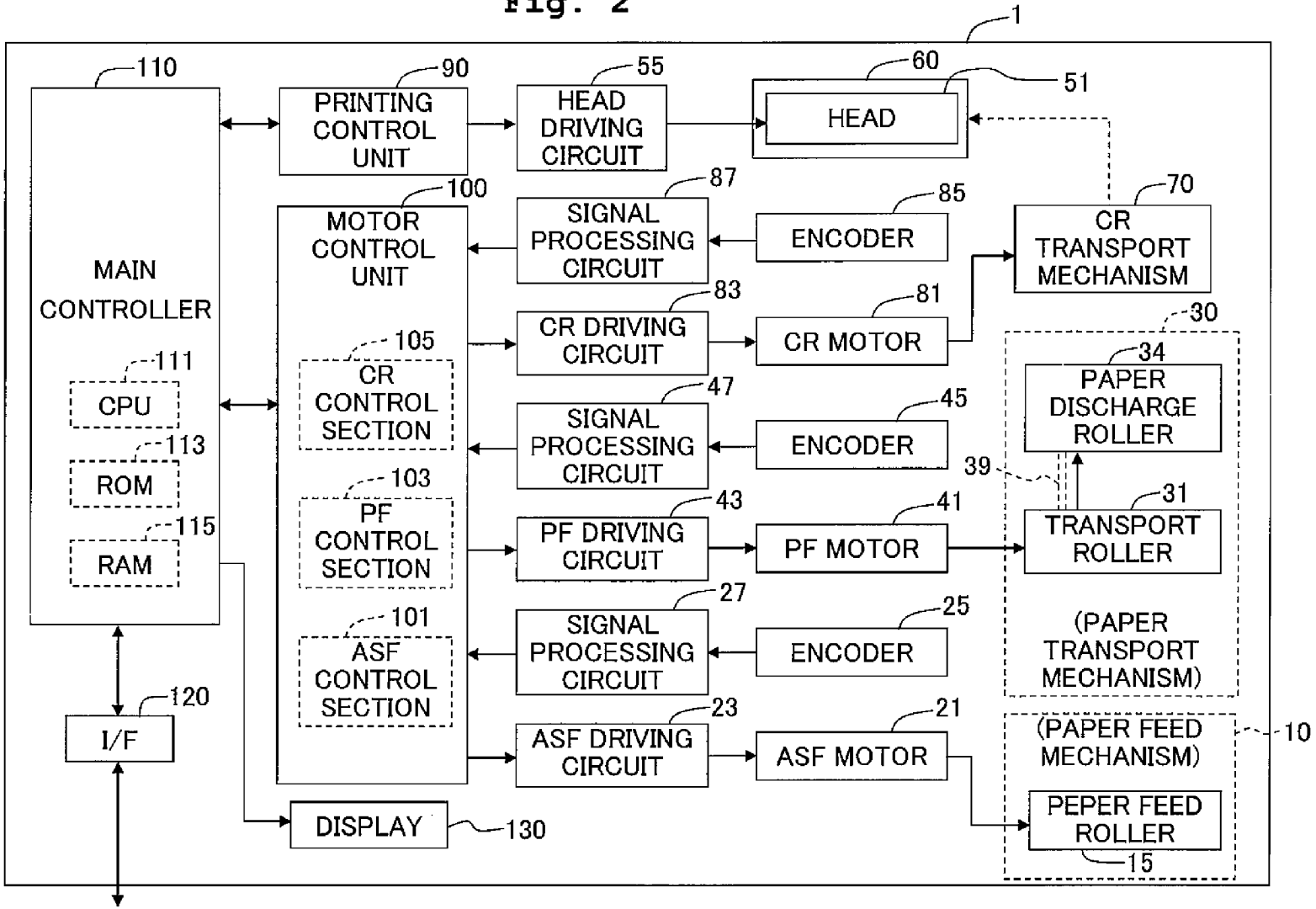
FIG. 2 is a block diagram showing a schematic construction of the image forming system.

As shown in FIG. 2, the paper feed roller 15 is driven by a ASF motor 21 which is a direct-current motor. A rotary encoder 25 is arranged at a rotational shaft of the paper feed roller 15 or a rotational shaft of the ASF motor 21. The rotary encoder 25 outputs a pulse signal depending on the rotation of the paper feed roller 15. The output signal is used for detecting a position X1 and a velocity V1 of the paper feed roller 15. The position X1 detected here represents a rotation amount of the paper feed roller 15 from a point in time at which reset is performed, and the velocity V1 represents a rotation speed of the paper feed roller 15. By rotating the paper feed roller 15, the paper Q transported to the downstream side from the paper feeding tray 11 is transported to the side of the transport roller 31 in a state that the movement of the paper Q is regulated by a U-turn path 17 forming the paper transport path.

A paper transport mechanism 30 provided for the image forming system 1 includes a transport roller 31, a pinch roller 32, a paper discharge roller 34, and a spur roller 35. The pinch roller 32 is disposed to face the transport roller 31, and the spur roller 35 is disposed to face the paper discharge roller 34. The paper discharge roller 34 is provided at the downstream side of the transport roller 31 in the paper transport path. A platen 37 is arranged between the transport roller 31 and the paper discharge roller 34.

As shown in FIG. 2, the transport roller 31 is driven by a PF motor 41 which is a direct-current motor. A rotary encoder 45 is arranged at a rotational shaft of the transport roller 31 or a rotational shaft of the PF motor 41. The rotary encoder 45 outputs a pulse signal depending on rotation of the transport roller 31. The output signal is used for detecting a position X2 and a velocity V2 of the transport roller 31. The position X2 detected here represents a rotation amount of the transport roller 31 from a point in time at which reset is performed, and the velocity V2 represents a rotation speed of the transport roller 31.

The paper discharger roller 34 is connected to the transport roller 31 via a belt mechanism 39 as shown in FIG. 2. The belt mechanism 39 includes, for example, a pair of pulleys provided in the rotational shafts of the transport roller 31 and the paper discharger roller 34 and an endless belt wound around the pair of pulleys. The transport roller 31 and the paper discharge roller 34 are rotated to cooperate with each other upon receiving motive power from the PF motor 41.

To add a remark, the paper transport mechanism 30 transports the paper Q supplied from the paper feed mechanism 10, downstream with the rotation of the transport roller 31 while nipping the paper Q between the transport roller 31 and the pinch roller 32. A nip position Pn at which the paper Q is nipped by the transport roller 31 corresponds to a point between the transport roller 31 and the pinch roller 32.

Further, the paper transport mechanism 30 nips the paper Q, which passed through the nip position Pn and has arrived at the paper discharger roller 34 in a state of being supported by the platen 37 from the lower position, between the paper discharge roller 34 and the spur roller 35 and transports the paper Q downstream with rotation of the paper discharge roller 34. The paper Q transported downstream by the paper discharge roller 34 is discharged to a paper discharge tray.

The ink-jet head 51 is carried on a carriage 60, and the ink-jet head 51 is driven by a head driving circuit 55 shown in FIG. 2 to jet the ink droplets downwardly. A CR transport mechanism 70 shown in FIG. 2 is a mechanism for transporting the carriage 60 in a main scanning direction perpendicular to a paper transport direction (a normal direction of the sheet surface of FIG. 1) upon receiving motive power from the CR motor 81 as the DC motor. The ink jet head 51 is reciprocatively moved in the main scanning direction in accordance with the movement of the carriage 60. The ink jet head 51 discharges the ink droplets downwardly while moving in the main scanning direction, and thereby forming an image in the main scanning direction on the paper Q.

A linear encoder 85 is arranged in a transport path of the carriage 60. The linear encoder 85 outputs a pulse signal depending on displacement of the carriage 60 in the main scanning direction. The output signal is used for detecting a position and a velocity of the carriage 60 in the main scanning direction.

Subsequently, an electrical configuration and a processing operation of the image forming system 1 will be explained in detail while referring to FIG. 2. In addition to the above parts or components, the image forming system 1 of this embodiment includes an ASF driving circuit 23, a signal processing circuit 27, a PF driving circuit 43, a signal processing circuit 47, a CR driving circuit 83, a signal processing circuit 87, a printing control unit 90, a motor control unit 100, a main controller 110, a communication interface 120, and a display 130.

A manipulated variable U1 for the ASF motor 21 is inputted to the ASF driving circuit 23 from the motor control unit 100. The ASF driving circuit 23 performs PWM control of the ASF motor 21 by applying a driving current which corresponds to the inputted manipulated variable U1 to the ASF motor 21. The signal processing circuit 27 detects the position X1 and the velocity V1 of the paper feed roller 15 based on the output signal from the rotary encoder 25.

A manipulated variable U2 for the PF motor 41 is inputted to the PF driving circuit 43 from the motor control unit 100. The PF driving circuit 43 performs PWM control of the PF motor 41 by applying a driving current which corresponds to the inputted manipulated variable U2 to the PF motor 41. The signal processing circuit 47 detects the position X2 and the velocity V2 of the transport roller 31 based on the output signal from the rotary encoder 45.

A manipulated variable for the CR motor 81 is inputted to the CR driving circuit 83 from the motor control unit 100. The CR driving circuit 83 performs PWM control of the CR motor 81 based on the inputted manipulated variable. The signal processing circuit 87 detects the position and the velocity of the carriage 60 based on the output signal from the linear encoder 85.

The printing control unit 90 controls the jetting operation of the ink droplets by the ink jet head 51 to form, on the paper Q, an image based on data to be printed which is designated by the main controller 110. The head driving circuit 55 causes the ink-jet head 51 to discharge the ink droplets based on a control signal from the printing control unit 90.

The motor control unit 100 is configured to control the ASF motor 21, the PF motor 41, and the CR motor 81 individually based on a command from the main controller 110. In particular, the motor control unit 100 includes an ASF control section 101, a PF control section 103, and a CR control section 105.

The ASF control section 101 controls the position X1 of the paper feed roller 15 by computing the manipulated variable U1 for the ASF motor 21 in accordance with a feedback control and inputting the manipulated variable U1 to the ASF driving circuit 23. The PF control section 103 controls the position X2 of the transport roller 31 by computing the manipulated variable U2 for the PF motor 41 in accordance with the feedback control and inputting the manipulated variable U2 to the PF driving circuit 43. The CR control section 105 controls the movement of the carriage 60 by computing the manipulated variable for the CR motor 81 in accordance with the feedback control and inputting the manipulated variable to the CR driving circuit 83.

The main controller 110 is configured to control the image forming system 1 in an integrated manner, and includes a CPU 111, a ROM 113, and a RAM 115. The CPU 111 executes processes in accordance with various programs stored in the ROM 113. The RAM 115 is used as a working memory when each of the processes is executed by the CPU 111.

In a case that the CPU 111 of the main controller 110 has received the data to be printed from an external apparatus via the communication interface 120, the CPU 111 inputs the command to the printing control unit 90 and the motor control unit 100 to form the image based on the data to be printed on the paper Q. The communication interface 120 includes a USB interface, a LAN interface, and the like, and the communication interface 120 is configured to be capable of communicating with the external apparatus such as a personal computer. The display 130 is made up of a liquid crystal display or the like, and the display 130 is controlled by the main controller 110 to display, for the user, variety of kinds of information such as occurrence of an error.

Subsequently, an explanation will be made about a configuration of a control system 200 included in each of the ASF control section 101 and the PF control section 103 with reference to FIG. 3. The control system 200 established in the ASF control section 101 has the same basic configuration as the control system 200 established in the PF control section 103. Thus, in the following description, a general explanation will be made about the control systems 200 established in the ASF control section 101 and the PF control section 103.

Figure 3:
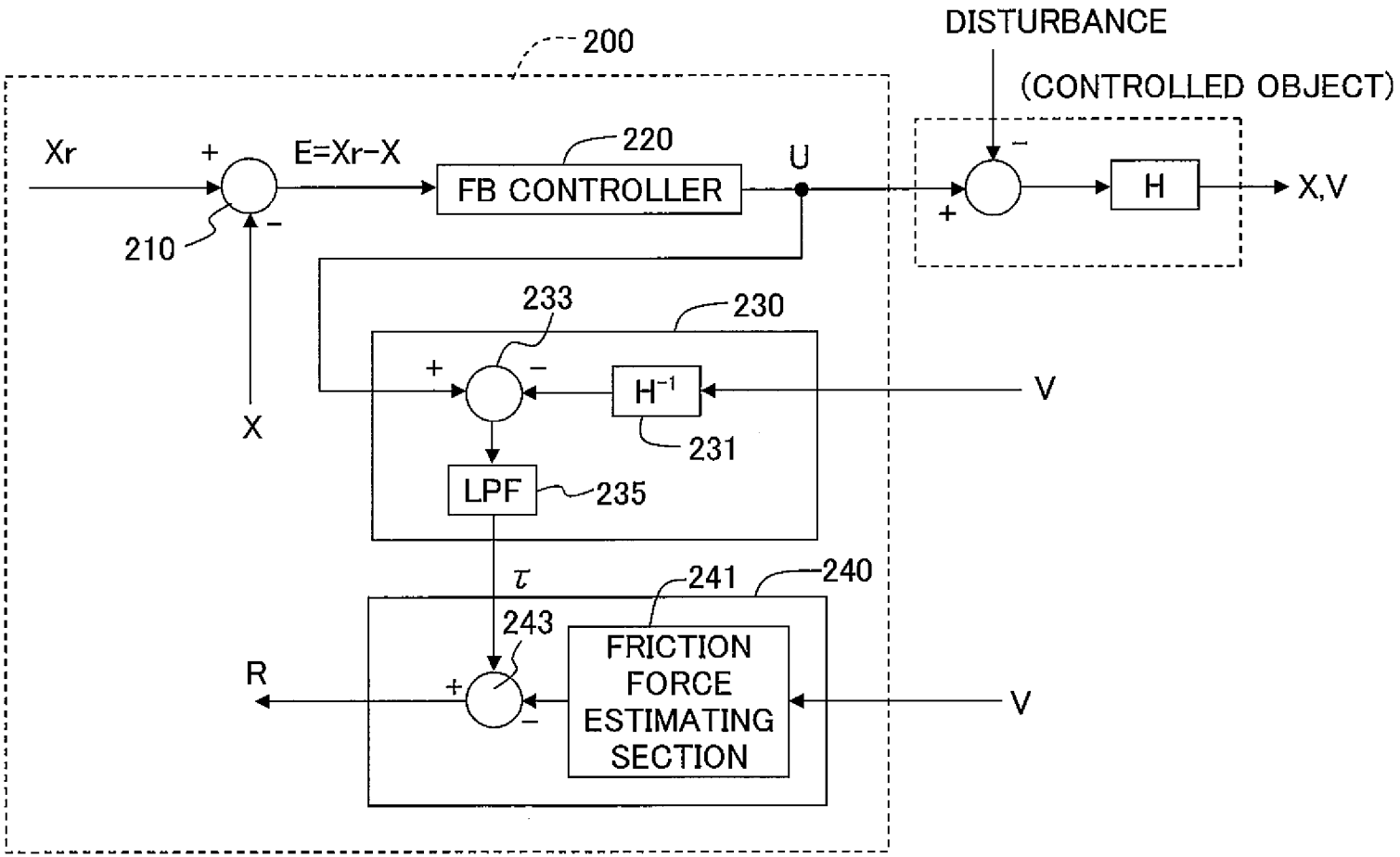
FIG. 3 is a block diagram conceptually showing a control system separately provided in an ASF control section and a PF control section.

In a case that the control system 200 is built in the ASF control section 101, a position X and a velocity V explained by using FIG. 3 correspond to the position X1 and the velocity V1 of the paper feed roller 15 detected by the signal processing circuit 27, and a target position Xr corresponds to a target value Xr1 of the position X1. Further, a manipulated variable U corresponds to the manipulated variable U1, and an estimated value of a reaction force R (hereinafter referred to as a reaction-force estimated value R) corresponds to an estimated value of a reaction force R1 acting on the ASF motor 21 (hereinafter referred to as a reaction-force estimated value R1). A controlled object shown in FIG. 3 corresponds to a transmission system ranging from the input of the manipulated variable U1 to the ASF driving circuit 23 to the detection of control output (position X1 and velocity V1) by the signal processing circuit 27.

In a case that the control system 200 is built in the PF control section 103, the position X and the velocity V explained by using FIG. 3 correspond to the position X2 and the velocity V2 of the transport roller 31 detected by the signal processing circuit 47, and the target position Xr corresponds to a target value Xr2 of the position X2. Further, the manipulated variable U corresponds to the manipulated variable U2, and the reaction-force estimated value R corresponds to an estimated value of a reaction force R2 acting on the PF motor 41 (hereinafter referred to as a reaction-force estimated value R2). The controlled object shown in FIG. 3 corresponds to a transmission system ranging from the input of the manipulated variable U2 to the PF driving circuit 43 to the detection of control output (position X2 and velocity V2) by the signal processing circuit 47.

As shown in FIG. 3, the control system 200 includes a deviation calculator 210, a FB controller 220, a disturbance observer 230, and a reaction force estimator 240. The deviation calculator 210 calculates the deviation or difference E=Xr−X between the detected position X and the target position Xr. The FB controller 220 is constructed of a PID controller and calculates the manipulated variable U so that the position X follows the target position Xr based on the deviation E. The manipulated variable U calculated by the FB controller 220 is inputted to both the controlled object and the disturbance observer 230.

The disturbance observer 230 is configured to estimate the disturbance acting on the controlled object, and includes an inverse model computing section 231, a subtracter 233, and a low-pass filter 235. The inverse model computing section 231 converts the velocity V detected by each of the signal processing circuits 27, 47 to a manipulated variable U* corresponding to the velocity V, by using a transfer function $H^{-1}$ of an inverse model which corresponds to a transmission model of the controlled object. The transfer function $H^{-1}$ can be defined by expressing an input-output characteristic model H by a rigid model, for example. In particular, the inverse number $H^{-1}=(1/K)\cdot s$, which is provided by expressing the input-output characteristic model as H=K/s by use of a constant K and Laplace operator s, can be defined as the transfer function $H^{-1}$.

The subtracter 233 calculates the deviation or difference (U−U*) between the manipulated variable U from the FB controller 220 and the manipulated variable U* calculated by the inverse model computing section 231. The low-pass filter 235 removes a high-frequency component from the deviation (U−U*). The disturbance observer 230 outputs the deviation (U−U*), from which the high-frequency component has been removed by the low-pass filter 235, as an estimated value of disturbance τ (hereinafter referred to as a disturbance estimated value τ). Since the manipulated variable U is an electric-current command value, a unit of the deviation (U−U*) is ampere. In a case that the direct-current motor is used as a driving source, a proportional relation is established between the ampere and torque (reaction force). Therefore, the deviation (U−U*) indirectly indicates the force as the disturbance acting on the controlled object.

The reaction force estimator 240 calculates the reaction-force estimated value R based on the disturbance estimated value τ. The disturbance estimated value τ includes a viscous friction component and a kinetic friction component associated with the rotation of the roller. The reaction force estimator 240 calculates the reaction-force estimated value R by removing the viscous friction component and the kinetic friction component from the disturbance estimated value τ.

For example, the reaction force estimator 240 is configured to calculate the reaction-force estimated value R by estimating the friction component included in the disturbance estimated value τ at a friction force estimating section 241 and subtracting an estimated value of the friction component from the disturbance estimated value τ at a subtracter 243. The friction force estimating section 241 is capable of calculating an estimated value of the viscous friction component (γ·V) by multiplying the velocity V of the roller by a predetermined coefficient γ. Then, by adding an estimated value of the kinetic friction component μN to the estimated value of the viscous friction component (γ·V), the estimated value of the friction component (γ·V+μN) can be calculated.

A time lag until an actual reaction force is reflected in the reaction-force estimated value R becomes smaller, as a cut-off frequency ωc of the low-pass filter 235 is set to have a larger value. However, if the value of the cut-off frequency ωc is too large, the reaction-force estimated value R is more likely to change or fluctuate, which raises the probability of the false detection of completion of a nip operation which will be described later. Therefore, in consideration of this point, a designer can determine an appropriate cut-off frequency ωc.

Figure 4A:
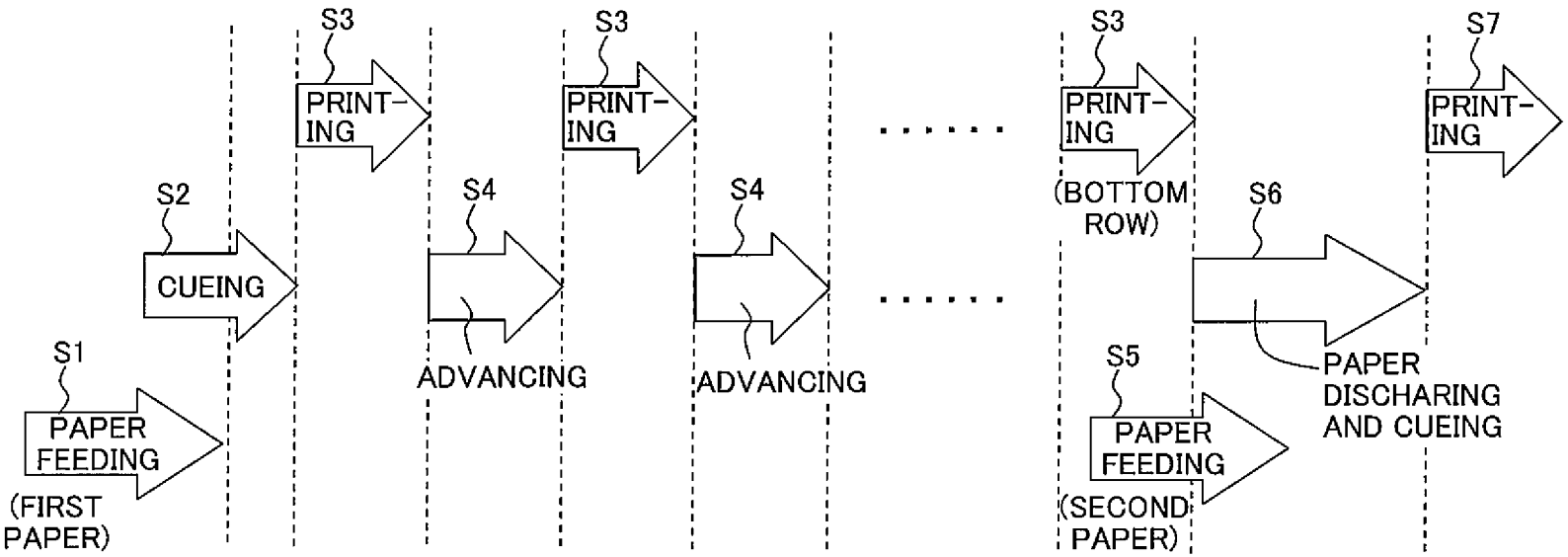
FIG. 4A is a diagram showing timings to execute a paper feeding process, a cueing process, a printing process, and an advancing process for the first paper and timings to execute the paper feeding process, the cueing process, and the printing process for the second paper.

Subsequently, an explanation will be made about a relationship between a transport operation of the paper Q in the image forming system 1 and an image forming operation (printing operation) onto the paper Q while referring to FIGS. 4A and 4B.

In the image forming system 1 of this embodiment, in a case that the data to be printed is received, the ASF control section 101 starts a paper feeding process S1 in accordance with a command from the main controller 110. The ASF control section 101 performs, as the paper feeding process S1, a process for controlling the rotation of the paper feed roller 15 to transport one paper Q from the paper feeding tray 11 to the nip position Pn of the transport roller 31. As shown at the left side of FIG. 4B, from among the paper feed roller 15 and the transport roller 31, only the paper feed roller 15 is rotated at the time of starting the paper feeding process S1.

Then, the PF control section 103 starts a cueing process S2 in accordance with a command from the main controller 110 before the paper Q arrives at the nip position Pn of the transport roller 31. The PF control section 103 performs, as the cueing process S2, a process for controlling the rotation of the transport roller 31 so as to stop the paper Q at a target cueing position. By starting the cueing process S2 with the PF control section 103, as shown at the center of FIG. 4B, the transport roller 31 rotates before the paper Q arrives at the nip position Pn of the transport roller 31.

Figure 4B:
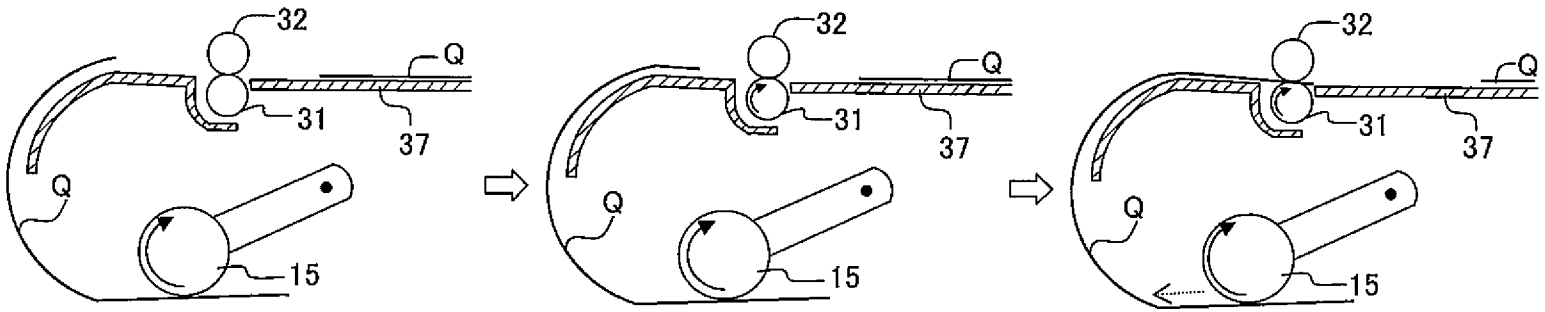
FIG. 4B is a diagram showing a state change of two sheets of paper Q, a paper feed roller, and a transport roller in an order starting from the left.
Figure 5A:
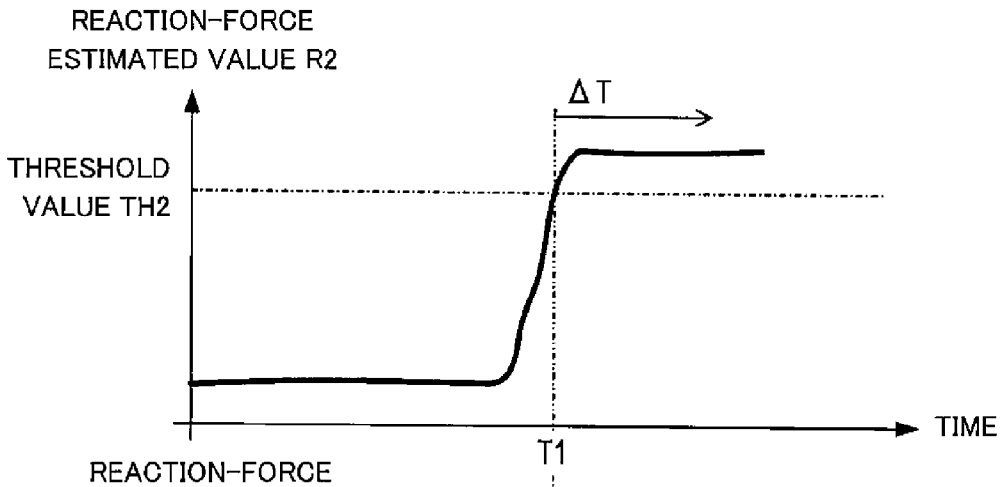
FIGS. 5A and 5B are graphs each showing an exemplary time-dependent change of an estimated value of a reaction force.

In the situation at the center of FIG. 4B, the reaction force acting on the PF motor 41 is small, because the transport roller 31 does not nip the paper Q at the time of starting the cueing process S2. On the other hand, the reaction force increases greatly at a point in time T1 immediately after the paper Q has arrived at the nip position Pn, because the transport roller 31 receives the action of the force from the paper Q. Therefore, the reaction-force estimated value R2 calculated by the PF control section 103 increases greatly. FIG. 5A is a graph showing the time-dependent change of the reaction-force estimated value R2 calculated by the PF control section 103.

Figure 5B:
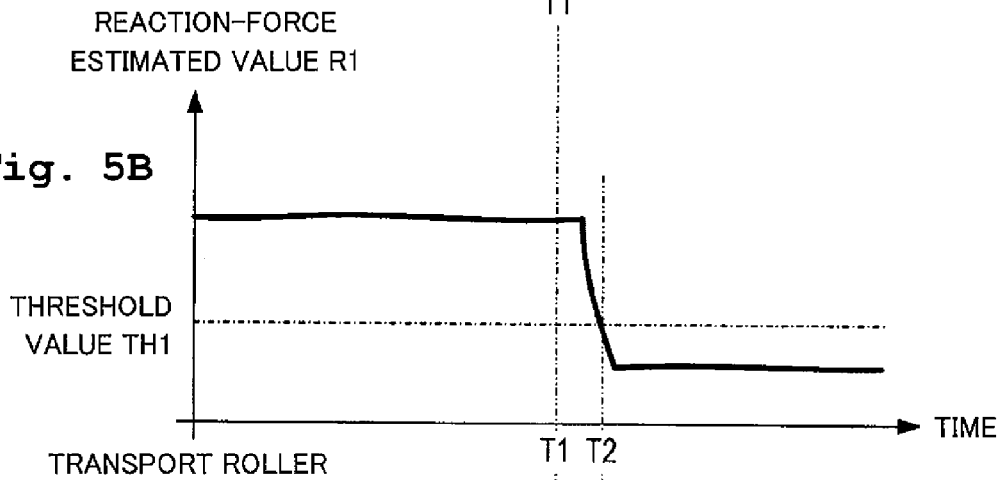

During the cueing process S2, when the paper Q has arrived at the nip position Pn and the paper Q has been started to be transported upon receiving the action of the force from the transport roller 31, the rear end side of the paper Q is pulled by the transport roller 31, as shown at the right side of FIG. 4B by a dotted-line arrow. This phenomenon reduces the reaction force acting on the paper feed roller 15 and the ASF motor 21, and consequently reduces the reaction-force estimated value R1 calculated by the ASF control section 101. FIG. 5B is a graph showing the time-dependent change of the reaction-force estimated value R1 calculated by the ASF control section 101.

Figure 5C:
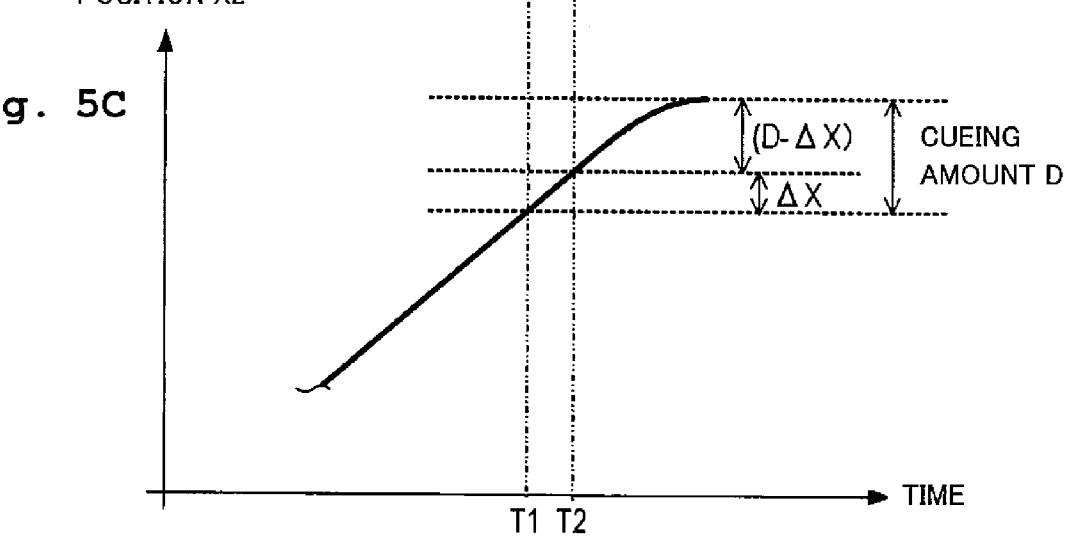
FIG. 5C is a graph showing an exemplary position locus of the transport roller with time.

The PF control section 103 corrects, at a point in time T2 at which the reaction-force estimated value R1 has changed to a threshold value TH1 or less, a locus (profile) of the target position Xr until the transport roller 31 is stopped. The PF control section 103 stops the paper Q at a point (cueing position) positioned on the downstream side from the nip position Pn by a predetermined cueing amount D by controlling the rotation of the transport roller 31 in accordance with the corrected profile. FIG. 5C is a diagram showing a locus of the position X2 of the transport roller 31 (indirectly, a locus of the position of the paper).

In a case that the cueing process S2 performed by the PF control section 103 is completed, the printing control unit 90 starts a printing process S3 in accordance with a command from the main controller 110 to allow the ink jet head 51 to discharge the ink droplets. In this situation, the CR control section 105 performs transport control of the carriage 60 in accordance with a command from the main controller 110.

After completion of the printing process S3, the PF control section 103 performs, as an advancing process S4, a process for controlling the rotation of the transport roller 31 to advance or transport the paper Q downstream by a predetermined amount in accordance with a command from the main controller 110. After completion of the advancing process S4 of the paper Q, the printing control unit 90 starts the printing process S3.

In the image forming system 1, the printing process S3 and the advancing process S4 are alternately performed to form the image based on the data to be printed on the paper Q. In a case that the data to be printed is data corresponding to an amount of a plurality of sheets of paper Q, the ASF control section 101 starts a paper feeding process S5 in accordance with a command from the main controller 110 during the execution of the printing process S3 in which the image is formed on the paper Q at a position corresponding to the bottom row. The ASF control section 101 controls the rotation of the paper feed roller 15 in the paper feeding process S5 to supply a subsequent sheet of paper Q (second paper Q) from the paper feeding tray 11 to the nip position Pn of the transport roller 31.

The content of the paper feeding process S5 is basically the same as that of the paper feeding process S1 for the first paper Q. Since the printing process S3 is being performed at the time of starting the paper feeding process S5, the transport roller 31 is in a halted state at the time of starting the paper feeding process S5. Thus, substantially similar to the left side of FIG. 4B, from among the paper feed roller 15 and the transport roller 31, only the paper feed roller 15 is rotated.

Thereafter, the PF control section 103 starts a cueing process S6 in accordance with a command from the main controller 110 at a timing before the second paper Q arrives at the nip position Pn of the transport roller 31 and at which the printing process S3 is completed. The cueing process S6 is performed basically similarly to the cueing process S2 for the first paper Q. In the cueing process S6, by performing the cueing of the second paper Q supplied to the nip position Pn, a paper discharge operation of the first paper Q (a preceding sheet of paper) onto the paper discharge tray is achieved at the same time, as shown at the right side of FIG. 4B.

After completion of the cueing process S6, a printing process S7 and an advancing or sending process for the second paper Q are alternately performed similar to the printing process S3 and the advancing process S4 for the first paper Q, thereby forming the image based on the data to be printed on the second paper Q.

In a case that the data to be printed is data corresponding to an amount of three sheets or more of paper Q, the ASF control section 101 starts a paper feeding process for a subsequent sheet of paper Q in accordance with a command from the main controller 110 during execution of a printing process in which an image is formed on a preceding sheet of paper Q at a position corresponding to the bottom row, similar to the paper feeding process S5 for the second paper Q. Processes subsequent to this process are similar to those performed for the second paper Q. When the printing process for the last page is completed, the PF control section 103 performs a paper discharge process in accordance with a command from the main controller 110.

Figure 6:
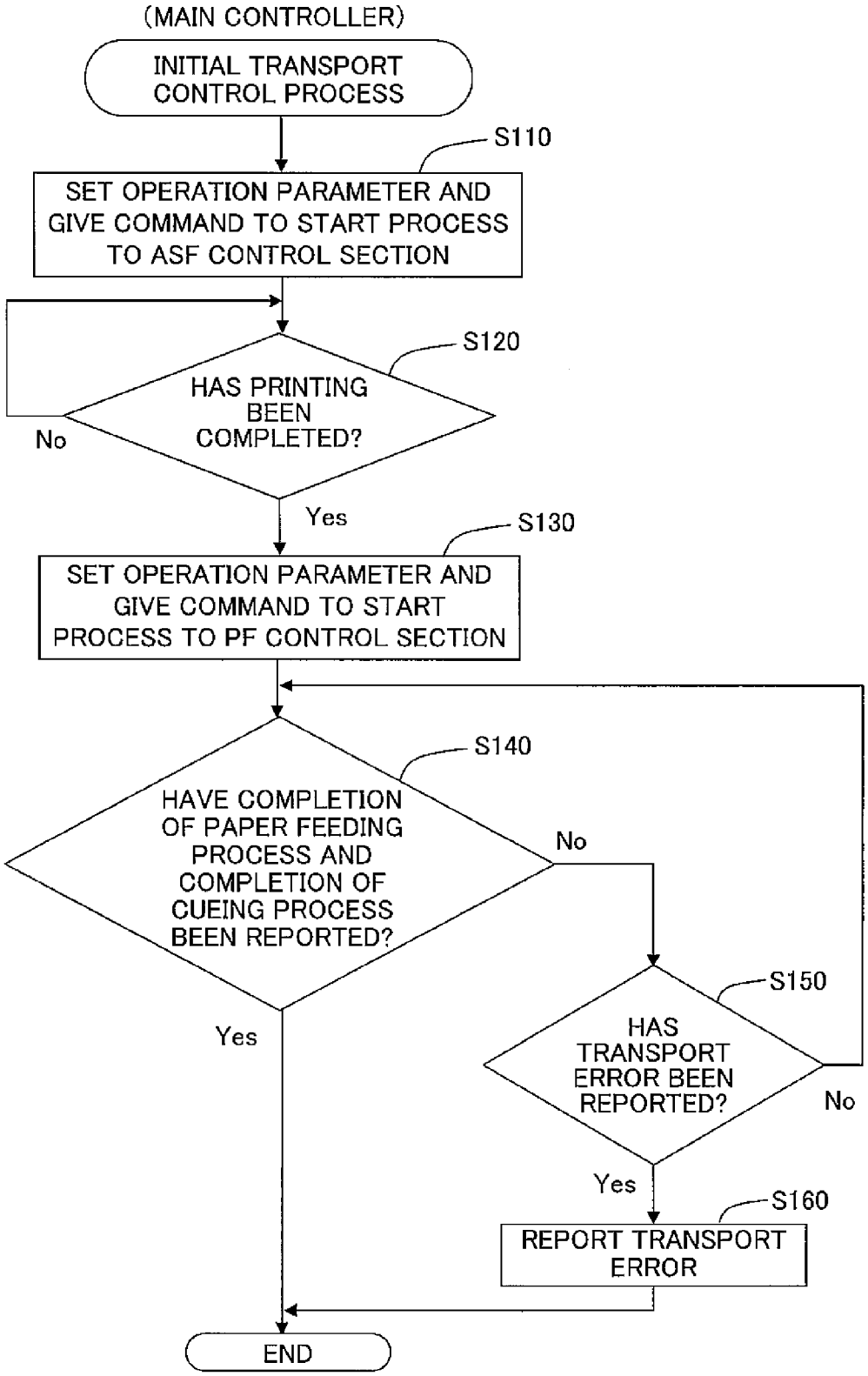
FIG. 6 is a flowchart showing an initial transport control process executed by a main controller.

Subsequently, an explanation will be made about an initial transport control process executed by the main controller 110 while referring to FIG. 6. The main controller 110 starts the initial transport control process shown in FIG. 6 when data to be printed is received or when a printing process is started on a preceding sheet of paper Q at a position corresponding to the bottom row during a continuous printing mode.

In a case that the initial transport control process is started and that a start condition of a paper feeding process is satisfied, the main controller 110 sets an operation parameter (details of which will be described later) in the ASF control section 101 and gives a command to start the paper feeding process to the ASF control section 101 (S110). The start condition is defined to start the paper feeding process by the ASF control section 101 at a timing at which a sheet of paper Q to be newly transported does not catch up with the preceding paper Q. In a case that the first paper Q is fed after the data to be printed has been received, there is no preceding paper Q. Thus, the main controller 110 can give the command to immediately start the paper feeding process to the ASF control section 101.

After completion of the process in S110, the main controller 110 waits until the printing process on the preceding paper Q at the position corresponding to the bottom row is completed (S120). In a case that the printing process has been completed (S120: Yes), the main controller 110 sets an operation parameter (details of which will be described later) in the PF control section 103 and gives a command to start a cueing process to the PF control section 103 (S130). In a case that there is no preceding paper Q, the main controller 110 can perform the process in S130 without waiting in S120.

After completion of the process in S130, the main controller 110 waits until completion of the paper feeding process is reported from the ASF control section 101 and completion of the cueing process is reported from the PF control section 103 or until a transport error of the paper Q is reported (S140, S150). In a case that the completion of the paper feeding process and the completion of the cueing process are reported (S140: Yes), the initial transport control process is completed. In a case that the initial transport control process is completed as described above, the main controller 110 gives a command to start a transport process of the carriage 60 to the CR control section 105 and gives a command to start the printing process to the printing control unit 90.

In a case that the transport error of the paper Q is reported from the PF control section 103 (S150: Yes), the main controller 110 reports the transport error of the paper Q to the user via the display 130 (S160), and then the initial transport control process is completed.

Figure 7:
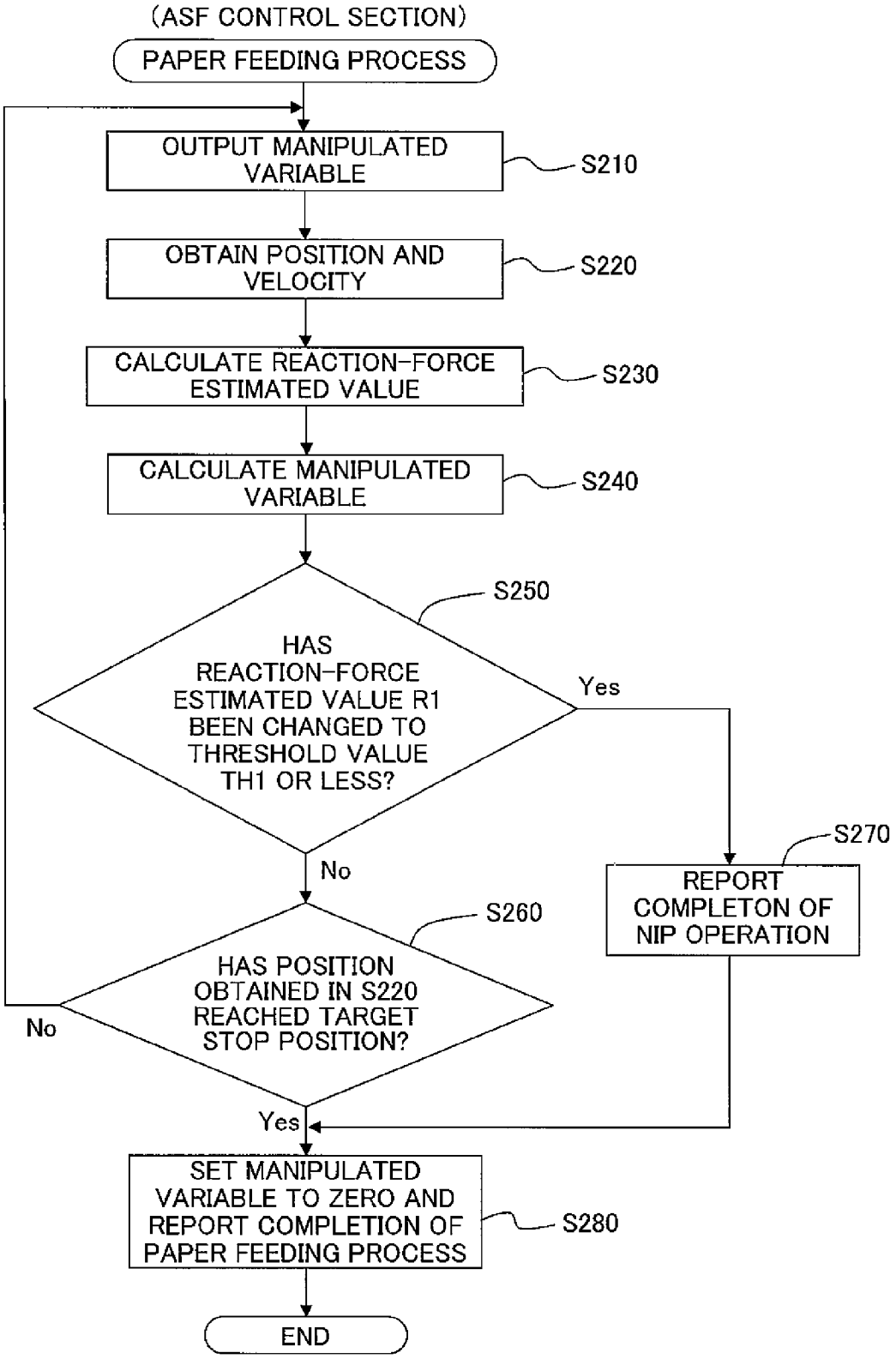
FIG. 7 is a flowchart showing the paper feeding process executed by the ASF control section.

In a case that the ASF control section 101 has received the command from the main controller 110 (S110), the ASF control section 101 starts the paper feeding process shown in FIG. 7 in accordance with the operation parameter set by the main controller 110. In this paper feeding process, the manipulated variable U1 inputted to the ASF driving circuit 23 is updated for each control cycle.

In a case that the paper feeding process is started, the ASF control section 101 inputs, to the ASF driving circuit 23, a manipulated variable U1 corresponding to the manipulated variable U1 calculated in S240 of the previous cycle, so that a driving current corresponding to the manipulated variable U1 is inputted to the ASF motor 21 (S210). However, in S210 immediately after the paper feeding process is started, the manipulated variable U1=0 is inputted to the ASF driving circuit 23.

Further, the ASF control section 101 obtains updates on the position X1 and the velocity V1 of the paper feed roller 15 detected by the signal processing circuit 27 (S220). In the following description, the position X1 is reset at a point in time of starting the paper feeding process, and is expressed by a coordinate system in which the origin is a position of the paper feed roller 15 at the point in time of starting the paper feeding process.

After the completion of the process in S220, the ASF control section 101 calculates a reaction-force estimated value R1 acting on the ASF motor 21 (S230). The calculation of the reaction-force estimated value R1 is achieved by using the disturbance observer 230 and the reaction force estimator 240 provided for the ASF control section 101 in accordance with the approach or technique as described above.

Thereafter, the ASF control section 101 calculates a manipulated variable U1 to be inputted to the ASF control driving circuit 23 in a subsequent control cycle, based on the position X1 and the target value Xr1 obtained in S220 (S240). The main controller 110 sets, as the operation parameter, a parameter defining a locus (function) of a target position of the paper feed roller 15.

The target position locus is defined as a locus including an acceleration section in which the paper feed roller 15 is rotated with increased velocity, a constant velocity section in which the paper feed roller 15 is rotated at a constant speed after the acceleration section, and a deceleration section in which the paper feed roller 15 is rotated with decreased velocity and is stopped after the constant velocity section. That is, the main controller 110 sets a parameter defining the position locus of each of these sections. The parameter defining the target position locus includes a parameter which designates a target stop position Xs1 as a terminal end position of the target position locus. The target stop position Xs1 is set to a value which is sufficiently larger than that of the position at which the paper Q transported from the paper feeding tray 11 arrives at the nip position Pn.

In S240, the ASF control section 101 calculates the deviation E1=Xr1−X1 between the target value Xr1 at the current time according to the target position locus and the position X1 obtained in S220. Then, the ASF control section 101 calculates such a manipulated variable U1 that the position X1 follows a target position Xr based on the deviation E1 (S240). The calculation of the manipulated variable U1 is achieved by using the deviation calculator 210 and the FB controller 220 provided for the ASF control section 101.

Further, the ASF control section 101 compares the reaction-force estimated value R1 and a threshold value TH1 set by the main controller 110 as the operation parameter (S250). In a case that a previous calculated value of the reaction-force estimated value R1 is more than the threshold value TH1 and that a present calculated value is not more than the threshold value TH1, the operation proceeds to S270. In a case other than the above case, the operation proceeds to S260.

In S270, the ASF control section 101 reports completion of the nip operation by the transport roller 31 to the PF control section 103. A point in time at which the completion of the nip operation is reported corresponds to a point in time T2 shown in FIGS. 5B and 5C. Then, the operation proceeds to S280 by the ASF control section 101. In S280, the ASF control section 101 inputs the manipulated variable U1=0 to the ASF driving circuit 23 and reports the completion of the paper feeding process to the main controller 110. Thereafter, the paper feeding process is completed.

In S260, the ASF control section 101 compares the position X1 and the target stop position Xs1. In a case that the position X1 obtained in S220 is not less than the target stop position Xs1, the operation proceeds to S280 by the ASF control section 101. On the other hand, in a case that the position X1 is less than the target stop position Xs11, the ASF control section 101 waits until a subsequent control cycle arrives. Then, the operation proceeds to S210 by the ASF control section 101 at a timing at which the subsequent control cycle has arrived, and the manipulated variable U1 calculated in S240 of the previous control cycle is inputted to the ASF driving circuit 23.

As described above, the ASF control section 101 performs, the output of the manipulated variable U1 (S210), the acquisition of the position X1 and the velocity V1 (S220), the calculation of the reaction-force estimated value R1 (S230), the calculation of the manipulated variable U1 to be outputted at the subsequent control cycle (S240), and the like, every time the control cycle arrives. The completion of the nip operation is reported to the PF control section 103 at the point in time at which the reaction-force estimated value R1 has changed to the threshold value TH1 or less (S270), and the rotation control of the paper feed roller 15 is completed. In other words, the application of the driving current to the ASF motor 21 is completed (S280).

Figure 8:
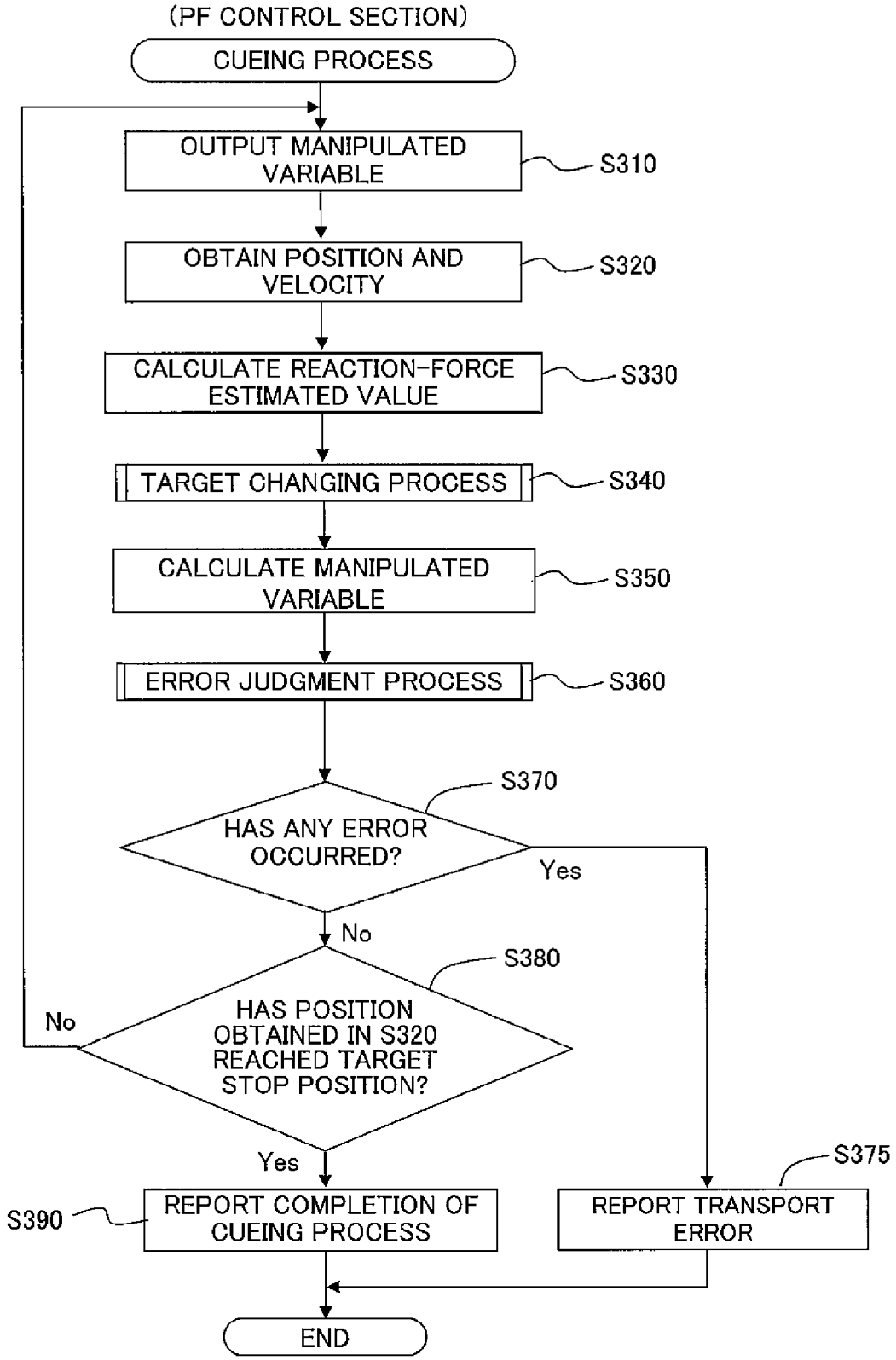
FIG. 8 is a flowchart showing the cueing process executed by the PF control section.

In a case that the PF control section 103 has received the command (S130) from the main controller 110, the cueing process shown in FIG. 8 is started in accordance with the operation parameter set by the main controller 110. In the cueing process, the manipulated variable U2 to be inputted to the PF driving circuit 43 is updated for each control cycle.

In a case that the cueing process is started, the PF control section 103 inputs, to the PF driving circuit 43, a manipulated variable U2 corresponding to the manipulated variable U2 calculated in S350 of the previous cycle, so that a driving current corresponding to the manipulated variable U2 is inputted to the PF motor 41 (S310). However, in S310 immediately after the cueing process is started, the manipulated variable U2=0 is inputted to the PF driving circuit 43.

Further, the PF control section 103 obtains updates on the position X2 and the velocity V2 of the transport roller 31 detected by the signal processing circuit 47 (S320). In the following description, the position X2 is reset at a point in time of starting the cueing process, and is expressed by a coordinate system in which the origin is a position of the transport roller 31 at the point in time of starting the cueing process.

Figure 9:
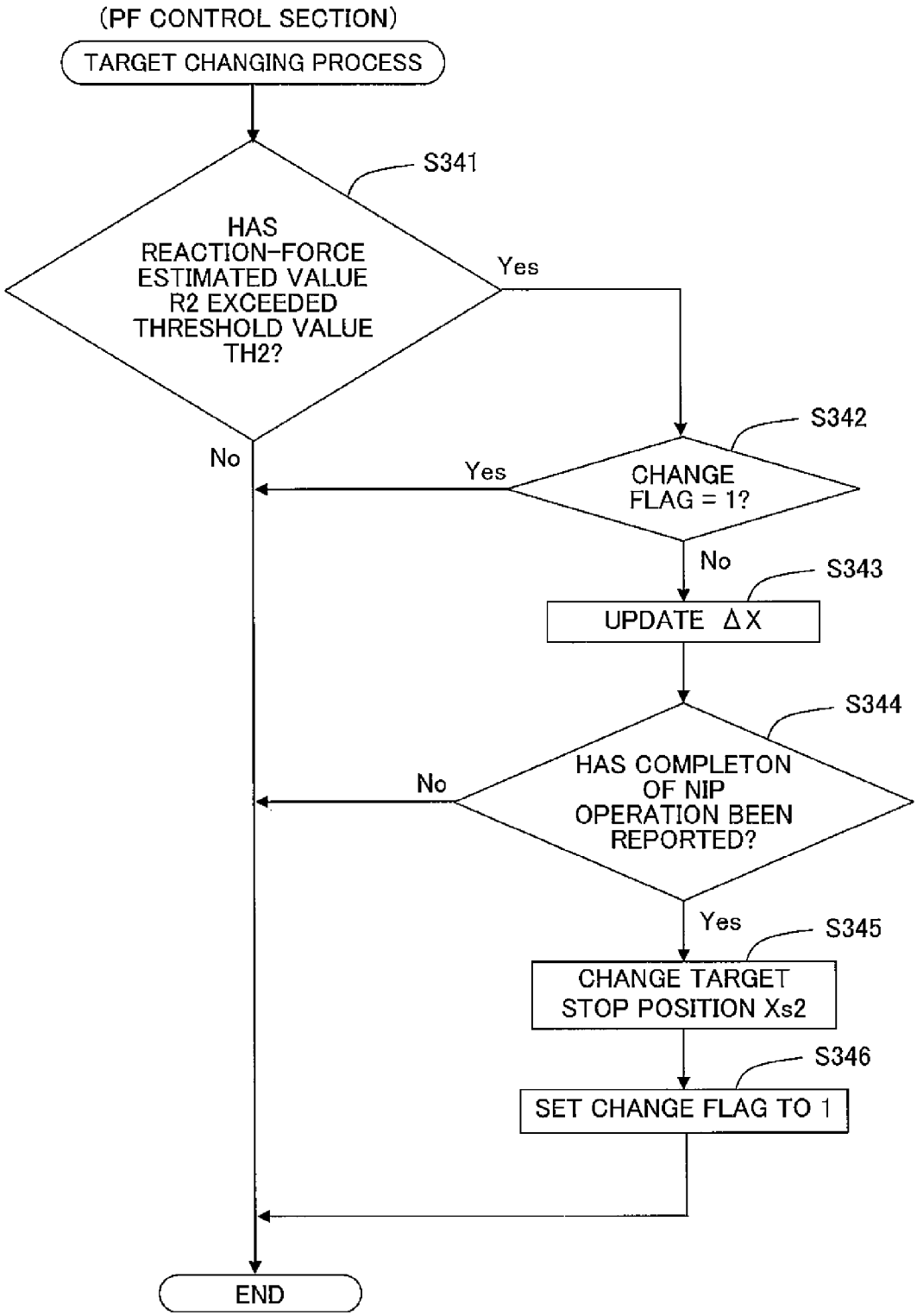
FIG. 9 is a flowchart showing a target changing process executed by the PF control section.

After the completion of the process in S320, the PF control section 103 calculates a reaction-force estimated value R2 acting on the PF motor 41 (S330). The calculation of the reaction-force estimated value R2 is achieved by using the disturbance observer 230 and the reaction force estimator 240 provided for the PF control section 103. Thereafter, the PF control section 103 performs a target changing process shown in FIG. 9 (S340).

In a case that the target changing process is started, the PF control section 103 compares the reaction-force estimated value R2 calculated in S330 and a threshold value TH2 set by the main controller 110 as the operation parameter (S341). The threshold value TH2 is a value for detecting occurrence of the phenomenon that the reaction force acting on the transport roller 31 and the PF motor 41 is increased upon the arrival of the paper Q at the nip position Pn of the transport roller 31. An adequate or proper value of the threshold value TH2 can be obtained, for example, by experiment.

The threshold value TH2 set in the cueing process for each paper Q subsequent to the first paper Q (i.e. having a preceding sheet of paper) is set to have a value different from the threshold value TH2 set in the cueing process for the first paper Q having no preceding paper. When it is performed the cueing process for the first paper Q having no preceding paper, the reaction force acting on the PF motor 41 is small. This is because, the paper Q is nipped by neither the transport roller 31 nor the paper discharge roller 34, the rollers 31 and 34 being driven by the PF motor 41. Therefore, the threshold value TH2 in the cueing process for the first paper Q having no preceding paper is set to have a value smaller than the threshold value TH2 in the cueing process for each paper Q subsequent to the first paper Q.

In a case that the reaction-force estimated value R2 is not more than the threshold value TH2 (S341: No), the target changing process is completed by the PF control section 103. On the other hand, in a case that the reaction-force estimated value R2 is greater than the threshold value TH2 (S341: Yes), the operation proceeds to S342. The processes ranging from S342 to S344 are repeatedly performed at and after the point in time T1 in examples of FIGS. 5A to 5C.

In a case that the operation proceeds to S342, the PF control section 103 confirms whether a value of a change flag is set to 1. The change flag is a flag, of which value is reset to 0 at the time of starting the cueing process and is set to 1 in the process of S346. In a case that the value of the change flag is set to 1 (S342: Yes), the target changing process is completed. On the other hand, in a case that the value of the change flag is 0 (S342: No), the operation proceeds to S343.

In a case that the operation proceeds to S343, the PF control section 103 updates a rotation amount ΔX of the transport roller 31 during a period from at the point in time T1 at which the reaction-force estimated value R2 has exceeded the threshold value TH2 until the current time, based on the position X2 obtained in S320.

In particular, the rotation amount ΔX is set to 0 by the PF control section 103 in S343 of the control cycle in which the reaction-force estimated value R2 has exceeded the threshold value TH2. Further, the PF control section 103 stores the position X2 at the point in time T1, and every time the process of S343 is performed thereafter, the PF control section 103 updates the rotation amount ΔX of the transport roller 31 by calculating the difference between the position X2 at the point in time T1 and the latest position X2 obtained in S320.

After the process in S343, in a case that the report of completion of the nip operation (S270) is not inputted from the ASF control section 101 (S344: No), the PF control section 103 ends the target changing process. Usually, the report of completion of the nip operation is inputted after the point in time T1 at which the reaction-force estimated value R2 becomes greater than the threshold value TH2. Thus, in S344, the PF control section 103 ignores any report of completion of the nip operation inputted before the point in time T1 (S344: No). That is, even when the report of completion of the nip operation has been inputted before the point in time T1, if no report is inputted after the point in time T1, the target changing process is completed.

In a case that the report of completion of the nip operation has been inputted (S344: Yes), the PF control section 103 performs a process in which a target position locus of the transport roller 31 is corrected by changing a target stop position Xs2 designated by the main controller 110 at the time of starting the cueing process (S345).

According to this embodiment, a parameter which defines the target position locus of the transport roller 31 including the target stop position Xs2 is set, as the operation parameter, by the main controller 110 at the time of starting the cueing process.

The target position locus is defined as a locus including an acceleration section in which the transport roller 31 is rotated with increased velocity, a constant velocity section in which the transport roller 31 is rotated at a constant speed after the acceleration section, and a deceleration section in which the transport roller 31 is rotated with decreased velocity and is stopped after the constant velocity section. That is, the main controller 110 sets a parameter defining the position locus of each of these sections.

In the cueing process, a peripheral or circumferential velocity of the transport roller 31 with rotating at the constant speed is controlled to be higher than a peripheral or circumferential velocity of the paper feed roller 15 with rotating at the constant speed. That is, the designer takes a diameter of each of the rollers into consideration to achieve the above relation, and determines a target velocity Vc1 in the constant velocity section of the transport roller 31 and a target velocity Vc2 in the constant velocity section of the paper feed roller 15.

The target stop position Xs2 designated at the time of starting the cueing process is set to have a value which is sufficiently larger than that of the position at which the paper Q has arrived at the cueing position. And further, the target position locus is defined to such a position locus that the paper Q arrives at the nip position Pn with the transport roller 31 rotating at the constant speed.

In S345, the target stop position Xs2 is changed to correct the target position locus to such a target position locus that the paper Q is arranged at the target cueing position. The target stop position Xs2 after the change is obtained by subtracting the latest rotation amount ΔX calculated in S343 from a rotation amount D of the transport roller 31 required for moving the paper Q from the nip position Pn to the target cueing position. That is, the target stop position Xs2 is changed to the value $Xs2=X2+(D-\Delta X)$ which is provided by adding the value $(D-\Delta X)$ obtained by the subtraction to the current position X2 of the transport roller 31 obtained in S320.

By changing the target stop position Xs2, the target position locus is corrected to such a locus that the transport roller 31 stops at the target stop position Xs2 corresponding to the target cueing position. That is, in S345, such a target position locus, in which the transport roller 31 is rotated by the rotation amount (D−ΔX) from the current time and is stopped at a point in time after the rotation, is set.

The correction of the target position locus can be achieved by shortening the constant velocity section of the original target position locus without substantially correcting the locus of the deceleration section. In this case, since the rotation amount of the transport roller 31 in the deceleration section is a constant value C, the target position locus can be corrected assuming that the time {(D−ΔX−C)/Vc2} which is obtained by dividing the value (D−ΔX−C), which is obtained by subtracting the constant value C from the value (D−ΔX), by the velocity Vc2 in the constant velocity section is regarded as a remaining time in the constant velocity section.

The report of completion of the nip operation is inputted to the PF control section 103 at the point in time T2 in FIGS. 5B and 5C. Therefore, the rotation amount ΔX used for changing the target stop position Xs2 corresponds to a rotation amount of the transport roller 31 during a period from the point in time T1 at which the reaction-force estimated value R2 has exceeded the threshold value TH2 until the point in time T2 at which the reaction-force estimated value R1 has changed to the threshold value TH1 or less.

The threshold value TH2 is defined by the designer to cause the phenomenon in which the reaction-force estimated value R2 becomes greater than the threshold value TH2 upon the arrival of the front end of the paper Q at the nip position Pn of the transport roller 31.

The phenomenon in which the reaction-force estimated value R1 is changed to the threshold value TH1 or less is caused when the paper Q has been started to be transported upon receiving the action of the force from the transport roller 31. This is because, when the paper Q is started to be transported by the transport roller 31, the force acts on a part of the paper Q on the side of the paper feed roller 15 to pull the part by the transport roller 31. The action of the force reduces the reaction force acting on the paper feed roller 15 and the ASF motor 21. According to this embodiment, in the cueing process, since the transport roller 31 is rotated at the peripheral velocity which is higher than the peripheral velocity of the paper feed roller 15 in the paper feeding process, the effect of decrease in the reaction force is more apparent.

According to this embodiment, in accordance with the principle as described above, the target stop position Xs2 of the transport roller 31 is corrected by detecting the change in the reaction force indicating that the paper Q has been started to be transported upon receiving the action of the force from the transport roller 31, and regarding the point in time T1 at which the change prior to said detection has occurred as a point in time at which the paper Q has arrived at the nip position Pn. Accordingly, the rotation of the transport roller 31 is controlled to arrange the paper Q at the target cueing position (target stop position Xs2) with high accuracy.

After the completion of change of the target stop position Xs2 in S345, the operation proceeds to S346 and the change flag is set to 1 by the PF control section 103. Then, the target changing process is completed. By performing the process in S346, the processes including S343 to S346 are not executed in a subsequent control cycle and the followings.

After the completion of the target changing process (S340), the operation proceeds to S350 by the PF control section 103 and the manipulated variable U2 is calculated based on the position X2 obtained in S320 and the target value Xr2. That is, the PF control section 103 calculates the deviation or difference E2=Xr2−X2 between the position X2 obtained in S320 and the target value Xr2 at the current time following the target position locus set from the main controller 110 or the target position locus corrected in S345. Then, based on the deviation E2, the manipulated variable U2 is calculated so that the position X2 follows the target value Xr2. The calculation of the manipulated variable U2 is achieved by using the deviation calculator 210 and the FB controller 220 provided for the PF control section 103.

Figure 10:
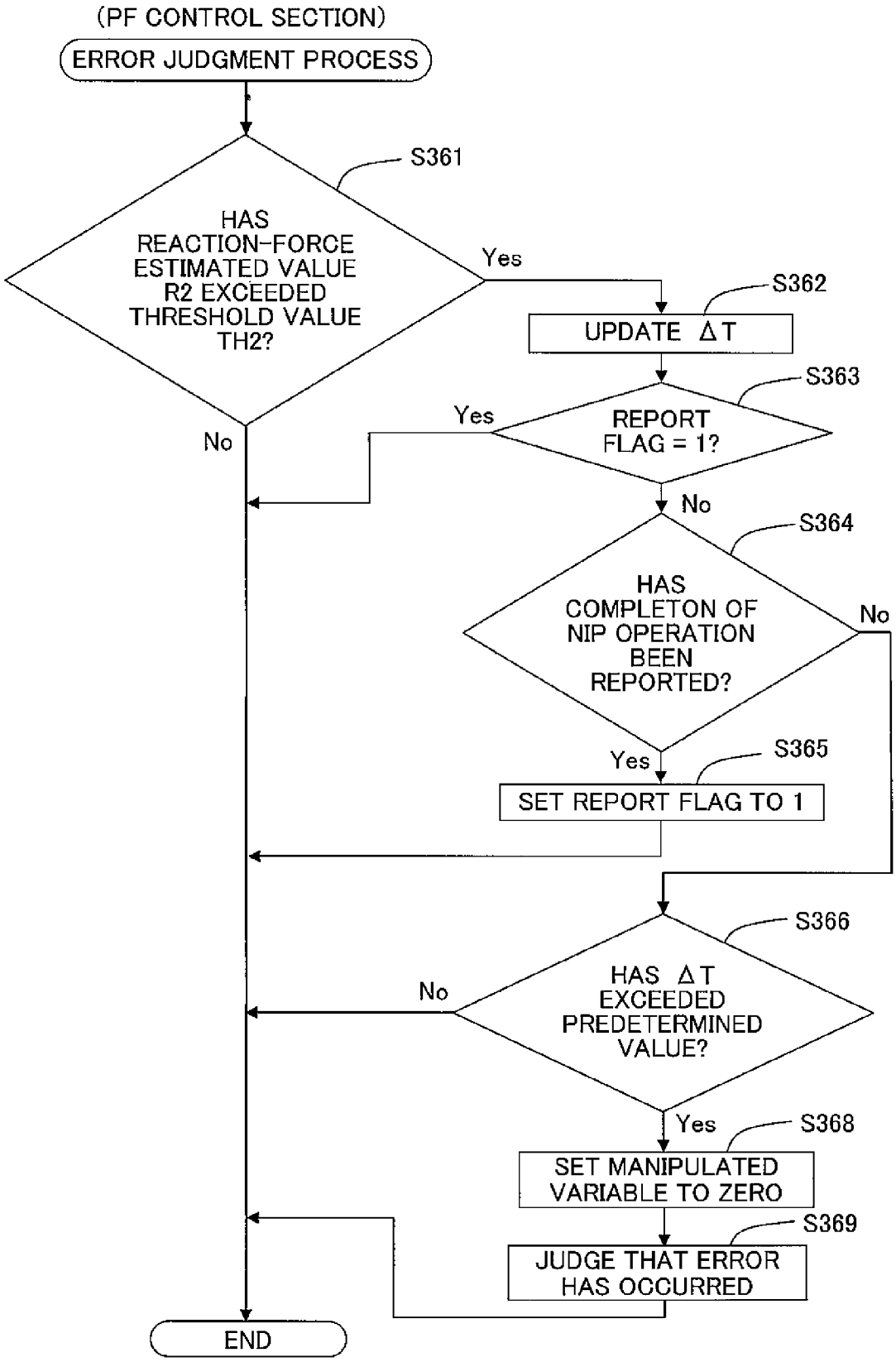
FIG. 10 is a flowchart showing an error judgment process executed by the PF control section.

After the completion of the process in S350, the operation proceeds to S360 by the PF control section 103 and an error judgment process shown in FIG. 10 is performed. When the error judgment process is started, the PF control section 103 compares the reaction-force estimated value R2 and the threshold value TH2 similar to the process in S341 of the target changing process (S361). In a case that the reaction-force estimated value R2 is the threshold value TH2 or less (S361: No), the error judgment process is completed by the PF control section 103.

On the other hand, in a case that the reaction-force estimated value R2 is greater than the threshold value TH2 (S361: Yes), the operation proceeds to S362 by the PF control section 103. In S362, the PF control section 103 calculates an elapsed time ΔT from the point in time T1 at which the reaction-force estimated value R2 has changed to be greater than the threshold value TH2. The process in S362 is repeatedly performed after the point in time T1 in the examples of FIGS. 5A to 5C.

Thereafter, the PF control section 103 confirms whether a value of a report flag is set to 1 (S363). The value of the report flag is reset to 0 at the point in time at which the cueing process is started and is set to 1 in S365. In a case that the value of the report flag is set to 1 (S363: Yes), the error judgment process is completed by the PF control section 103. On the other hand, in a case that the value of the report flag is 0 (S363: No), the process proceeds to S364 by the PF control section 103. Then, in a case that the report of completion of the nip operation has been inputted (S364: Yes), the error judgment process is completed after the value of the report flag is set to 1 (S365).

In a case that the report of completion of the nip operation is not inputted (S364: No), the PF control section 103 confirms whether the elapsed time ΔT from the point in time T1 exceeds a predetermined value (S366). In a case that the elapsed time ΔT does not exceed the predetermined value (S366: No), the error judgment process is completed. On the other hand, in a case that the elapsed time ΔT has exceeded the predetermined value (S366: Yes), the operation proceeds to S368 by the PF control section 103.

In a case that the operation proceeds to S368, the PF control section 103 stops the PF motor 41 by inputting the manipulated variable U2=0 for the PF motor 41 to the PF driving circuit 43. Further, the PF control section 103 judges that the transport error of paper Q has occurred (S369), and then the error judgment process is completed.

After the completion of the error judgment process (S360), the PF control section 103 switches a subsequent process based on a judgment result of the error judgment process (S370). That is, in a case that it is judged in the error judgment process that the transport error has occurred (S370: Yes), the PF control section 103 reports the occurrence of the transport error to the main controller 110 (S375), and the cueing process is completed.

In a case that it is judged in the error judgment process that no transport error has occurred (i.e., in a case that the operation does not proceed to S368 and S369), the operation proceeds to S380 by the PF control section 103 and the PF control section 103 compares the position X2 and the target stop position Xs2.

In a case that the position X2 of the transport roller 31 has arrived at the target stop position Xs2 (S380: Yes), the PF control section 103 reports the completion of the cueing process to the main controller 110 (S390), and the cueing process is completed.

In a case that the position X2 of the transport roller 31 does not arrive at the target stop position Xs2 (S380: No), the PF control section 103 waits until the arrival of a subsequent control cycle. The operation proceeds to S310 by the PF control section 103 at a timing at which the subsequent control cycle has arrived, and the manipulated variable U2 calculated in S350 of the previous control cycle is inputted to the PF driving circuit 43.

As described above, the PF control section 103 performs the output of the manipulated variable U2 (S310), the acquisition of the position X2 and the velocity V2 (S320), the calculation of the reaction-force estimated value R2 (S330), the calculation of the manipulated variable U2 to be outputted at the subsequent control cycle (S350), and the like, every time the control cycle arrives, until any transport error occurs or the position X2 of the transport roller 31 reaches the target stop position Xs2.

In the above description, the explanation has been made about the configuration of the image forming system 1 of this embodiment. According to this embodiment, those detected in the image forming system 1 include the change in which the reaction-force estimated value R2 has exceeded the threshold value TH2 upon the arrival of the paper Q at the nip position Pn and the change in which the reaction-force estimated value R1 has become the threshold value TH1 or less when the paper Q has been started to be transported upon receiving the action of the force from the transport roller 31. In a case that the paper Q is arranged at the target cueing position, the target position locus and the target stop position Xs2 are corrected at the point in time T2 at which the reaction-force estimated value R1 has become the threshold value TH1 or less.

In this situation, the PF control section 103 specifies the rotation amount ΔX of the transport roller 31 during the period from the point in time T1 at which the reaction-force estimated value R2 has exceeded the threshold value TH2 until the point in time T2 at which the reaction-force estimated value R1 has become the threshold value TH1 or less. Then, the rotation amount of the transport roller 31 during the period from the point in time T2 until the transport roller 31 is stopped is corrected to the value (D−ΔX) obtained by subtracting the specified rotation amount ΔX from the rotation amount D of the transport roller 31 required for transporting the paper Q from the nip position Pn to the target cueing position.

Therefore, according to this embodiment, it is possible to arrange the paper Q at the target cueing position positioned downstream of the nip position Pn with high accuracy. That is, in conventional techniques, the arrival of the front end of the paper at the nip position of the transport roller 31 is estimated based on the position count value after the detection of the front end of the paper with the sensor. On the other hand, in this embodiment, the transport condition of the paper is estimated based on the change in the reacting force acting on the ASF motor 21 and the PF motor 41.

Therefore, even under such an environment that the error occurs between the rotation amount of the paper feed roller 15 and an amount of displacement of the paper Q, the position X2 of the transport roller 31 at the point in time at which the paper Q has reached the nip position Pn can be specified and the paper Q can be arranged at the target cueing position with high accuracy. Consequently, according to this embodiment, the image can be formed in the area of the paper Q designated by the user with high accuracy to achieve a high-quality image printing.

Further, according to this embodiment, since the changes in both the reaction-force estimated value R1 and the reaction-force estimated value R2 are detected, it is possible to prevent the adjustment of the cueing position based on the change in the reaction force unrelated to the phenomenon in which the paper Q has been started to be transported upon receiving the action of the force from the transport roller 31. As a result, the error or malfunction can be avoided.

Further, the image forming system 1 of this embodiment is configured as follows. That is, in a case that a situation, in which the reaction-force estimated value R1 is not changed to the threshold value TH1 or less in spite of the increase in the reaction-force estimated value R2, is continued for a predetermined time, the transport error of the paper Q is detected by taking into consideration the possibility of occurrence of the paper jam etc. Then, the transport of the paper Q by the transport roller 31 is stopped and the transport error is reported to the user via the display 130. Therefore, according to this embodiment, it is possible to also address the transport error properly.

Other Embodiments

In the above description, the explanation has been made about the embodiment of the present teaching. The present teaching, however, is not limited to the above embodiment, and the present teaching can adopt various aspects. For example, the image forming system 1 may be configured to change the target stop position Xs2 assuming that the rotation amount ΔX of the transport roller 31 during the period from the point in time T1 until the point in time T2 is a constant value. In this case, the image forming system 1 may be configured to change the target stop position Xs2 at the point in time T2 at which the reaction-force estimated value R1 has become the threshold value TH1 or less, without observing the change in which the reaction-force estimated value R2 has exceeded the threshold value TH2.

The technique concerning the transport of the paper according to this embodiment can be applied also to a system other than the image forming system. Further, in this technique, a transport object is not limited to the paper and this technique can be applied to various systems in which a sheet-shaped object is transported. Further, the function of the motor control unit 100 can be achieved by a dedicated hardware circuit and/or by causing the computer to execute programs stored in a computer readable medium such as the ROM.

The correspondence or correlation between the terms is as follows. The ASF motor 21 corresponds to an example of a first motor, and the paper feed roller 15 corresponds to an example of a first roller. The PF motor 41 corresponds to an example of a second motor, and the transport roller 31 corresponds to an example of a second roller. The function achieved by the motor control unit 100 corresponds to an example of function achieved by a controller. The paper feeding process (except for S230) executed by the ASF control section 101 corresponds to an example of a first process, and the cueing process (except for S330) executed by the PF control section 103 corresponds to an example of a second process. The function achieved by S230 in the paper feeding process corresponds to an example of function achieved by a first reaction-force estimating observer, and the function achieved by S330 in the cueing process corresponds to an example of function achieved by a second reaction-force estimating observer.

What is claimed is:

1. A sheet transport apparatus, comprising:

a first motor and a second motor;

a first roller configured to: rotate upon receiving motive power from the first motor; and transport a sheet in a predetermined transport direction;

a second roller which is provided on a downstream side of the first roller in the transport direction and which is configured to: rotate upon receiving motive power from the second motor while nipping the sheet transported by the first roller at a nip position; and transport the sheet further downstream in the transport direction; and a controller, wherein the controller includes:

a motor control unit configured to perform a first process in which the first motor is controlled to rotate the first roller and a second process in which the second motor is controlled to rotate the second roller; and a first reaction-force estimating observer configured to calculate a first estimated value which is an estimated value of a reaction force acting on the first motor, based on control input for the first motor and control output corresponding to the control input, the motor control unit is configured to:

start the second process before the sheet transported in the first process arrives at the nip position;

determine a rotation amount of the second roller during a period from a reaction-force change point at which a predetermined change has occurred in the first estimated value until the second roller stops, on condition that the predetermined change has occurred in the first estimated value, the predetermined change indicating that the sheet has been started to be transported upon receiving action of force from the second roller; and arrange the sheet at a target position positioned on a downstream side of the nip position in the transport direction by controlling the second motor in the second process, so that the second roller rotates by the rotation amount determined by the motor control unit during the period from the reaction-force change point until the second roller stops.

2. The sheet transport apparatus according to claim 1, wherein the motor control unit is configured to rotate the second roller at a peripheral velocity, which is higher than a peripheral velocity of the first roller in the first process, in the second process; and the predetermined change is a change in which the first estimated value becomes a predetermined threshold value or less.

3. The sheet transport apparatus according to claim 1, wherein the controller further includes a second reaction-force estimating observer configured to calculate a second estimated value which is an estimated value of a reaction force acting on the second motor, based on control input for the second motor and control output corresponding to the control input; and the motor control unit is configured to determine the rotation amount of the second roller, on condition that the predetermined change has occurred in the first estimated value after a preceding change, which indicates that the sheet has arrived at the nip position, has occurred in the second estimated value.

4. The sheet transport apparatus according to claim 3, wherein the motor control unit is configured to:

specify the rotation amount of the second roller during a period from a point in time at which the preceding change has occurred in the second estimated value until the reaction-force change point; and determine a value, which is obtained by subtracting the specified rotation amount from a rotation amount of the second roller required to transport the sheet from the nip position to the target position, as the rotation amount of the second roller during the period from the reaction-force change point until the second roller stops.

5. The sheet transport apparatus according to claim 3, wherein the motor control unit is configured to:

rotate the second roller at a peripheral velocity, which is higher than a peripheral velocity of the first roller in the first process, in the second process; and determine the rotation amount of the second roller, on condition that the preceding change, in which the second estimated value exceeds a reference value, has occurred and then the predetermined change, in which the first estimated value becomes a predetermined threshold value or less, has occurred.

6. The sheet transport apparatus according to claim 3, wherein the motor control unit is configured to perform a predetermined process for addressing a transport error of the sheet, in a case that the predetermined change does not occur in the first estimated value within a predetermined period of time elapsed after the point in time at which the preceding change has occurred in the second estimated value.

7. The sheet transport apparatus according to claim 6, wherein the motor control unit is configured to perform at least one of a process for reporting the transport error from a reporting device to a user and a process for stopping the second motor to complete the second process, as the predetermined process for addressing the transport error of the sheet.

8. An image forming system, comprising:

the sheet transport apparatus as defined in claim 1; and an image forming apparatus which is provided on a downstream side of the second roller in the transport direction and is configured to form an image on the sheet.

* * * * *